United States Patent [19]

Hashimoto

[11] Patent Number: 4,480,185

[45] Date of Patent: Oct. 30, 1984

[54] NEUTRAL BEAM INJECTOR

[75] Inventor: Kiyoshi Hashimoto, Yokohama, Japan

[73] Assignee: Tokyo Shibaura Denki Kabushiki Kaisha, Kawasaki, Japan

[21] Appl. No.: 329,069

[22] Filed: Dec. 9, 1981

[30] Foreign Application Priority Data

Dec. 22, 1980 [JP] Japan ..... 55-180404

[51] Int. Cl.[3] ..... H05H 3/02

[52] U.S. Cl. ..... 250/251; 376/130

[58] Field of Search ..... 250/251; 376/130

[56] References Cited

PUBLICATIONS

Proceedings of 6th Symposium on Engineering Problems of Fusion Research, San Diego, California, 1975, p. 184, D. J. Bender, W. L. Barr and R. W. Moir, (see FIG. 10).

*Primary Examiner*—Alfred E. Smith
*Assistant Examiner*—Jack I. Berman
*Attorney, Agent, or Firm*—Oblon, Fisher, Spivak, McClelland & Maier

[57] ABSTRACT

A neutral beam injector comprising a neutralizing cell for neutralizing charged particles, and a direct converter for recovering the energy of unneutralized charged particles passed through the neutralizing cell.

The direct converter comprises a collector for collecting charged particles, a deflector which is interposed between the neutralizing cell and the collector in order to cross and diverge beams of the charged particles, a first electron suppressor interposed between the neutralizing cell and the deflector, and a second electron suppressor disposed behind the collector.

4 Claims, 7 Drawing Figures

POTENTIAL DISTRIBUTION

POTENTIAL DISTRIBUTION

NEUTRAL BEAM INJECTOR

BACKGROUND OF THE INVENTION

The present invention relates to a neutral beam injector which is capable of recovering the energy of charged particles.

FIG. 1 is a schematic view of a neutral beam injector which heats a plasma inside a fusion reactor. A description will now be made with reference to a deuterium ion beam. Neutral deuterium molecules $D_2$ are ionized in a discharge chamber 10. The deuterium ions $D^+$ are accelerated to become high energy ions while passing through an accel-decel grid 12. The high energy deuterium ions $D^+$ are guided to a neutralizing cell 14 which is charged with a neutral deuterium gas at a relatively high pressure. In the neutralizing cell 14, the high-energy deuterium ions $D^+$ are subjected to charge-exchange reaction with the neutral deuterium molecules to become high-speed neutral particles $D^\circ$. These neutral deuterium particles $D^\circ$ are injected in the plasma in a fusion reactor (not shown) to heat the plasma. The neutralization efficiency in the neutralizing cell 14 decreases with an increase in ion energy E as shown in FIG. 2. This data in FIG. 2 is disclosed in "Mixed Species in Intense Neutral Beams", K. H. Berkner, R. V. Pyle and J. W. Stearns, Proc. 1st. Topical Meeting on Tech. Cont. Nucl. Fusion, Proc. CONF-740402-PI, San Diego, Calif., 1974, vol. 1, pp. 392 to 400. The unneutralized ions are deviated from the flow of the neutral beam due to the self electric field and collide with the wall of the chamber, so that they consume their energy. In order to obtain neutral particles using high energy ions of 200 keV, it is important to effectively utilize the consumed energy and to prevent damage to the wall of the chamber or the like. For this purpose, a direct converter 16 is generally incorporated. The energy recovered by the direct converter 16 can be again utilized to obtain the high energy deuterium ions. An example of a direct converter of this type is disclosed in "Performance Analysis of In-Line Direct Converters for Neutral Beam Sources", D. J. Bender, W. L. Barr, and R. W. Moir, Proceedings of 6th Symposium on Engineering Problems of Fusion Research, San Diego Calif., 1975, pp. 184 to 190.

A neutral beam injector having a typical conventional direct converter will be described with reference to FIGS. 3 and 4. FIG. 3 is a schematic sectional view of a neutral beam injector 18, and FIG. 4 is a graph showing the potential distribution at each part of the neutral beam injector 18. The neutral beam injector 18 comprises a vacuum vessel 20, cryo pumps 22 for evacuating the vacuum vessel 20, a gas feed 24 for feeding the neutral molecules, a discharge chamber 10 having an electron-emissive filament 26 and a discharge electrode 28, an accel-decel grid 12, a neutralizing cell 14, a direct converter 16, and a drift tube 30 for guiding the high-speed neutral particles to the plasma. The direct converter 16 comprises of a collector 32 and a pair of electron suppressors 34*a* and 34*b* which are arranged in front of and behind the collector 32, respectively. The electron suppressor 34*a* prevents the electrons generated in the neutralizing cell 14 from flowing to the collector 32. The electron suppressor 34*b* prevents the electrons generated in the drift tube 30 from flowing to the collector 32. Cooling pipes 36 for preventing the temperature of the collector 32 and the suppressors 34*a* and 34*b* from rising are arranged around the collector

32 and the electron suppressors 34*a* and 34*b*. The collector 32 and the electron suppressors 34*a* and 34*b* are held inside the vessel 20 by means of insulators 38. The vessel 20, the neutralizing cell 14, and a first grid 12*a* are electrically connected each other. The first grid 12*a*, a second grid 12*b*, a third grid 12*c* and the discharge electrode 28 are insulated from each other by means of a insulator 40. The electron-emissive filament 26 and the discharge electrode 28 are also insulated by means of insulators 42.

The neutral beam injector 18 is electrically connected as shown in FIG. 3. The vacuum vessel 20, the neutralizing cell 14 connected to the vessel 20, and the first grid 12*a* in the accel-decel grid 12 are grounded. The filament 26 is connected to a filament heater power source B1, while the discharge electrode 28 is connected to a discharge power source B2. The third grid 12*c* is connected to the discharge power source B2 through a resistor R. The second grid 12*b* is set at a negative potential by a power source B3. Therefore, the second grid 12*b* functions as a decel grid for preventing back streaming of the electrons.

The discharge electrode 28 is set at a positive high potential Va, for example, 200 kV, by power sources B4 and B5. Therefore, the ions receive an energy corresponding to the potential Va. The electron suppressor 34*a* is set at a negative potential −Vsupl, for example, −60 kV, by a power source B6. The electron suppressor 34*b* is set at a negative potential −Vsup2, for example, −20 kV, by a power source B7. The collector 32 is connected to a node of the power sources B4 and B5. Therefore, the potential of the collector 32 is set at a positive potential Vcol, for example, 190 kV, by the power source B4. The potential distribution of the respective parts of the neutral beam injector 18 described above becomes as shown in FIG. 4. In order to avoid energy losses, it is necessary to reduce the difference $\delta V$ between the potential Vcol of the collector 32 and the potential Va of the high energy ions.

The conventional neutral beam injector 18 has drawbacks to be described below. Since the deflection of the ion beam is caused by the repelling force of the charges in the ion beam itself, the ion beam is not much deflected within a short travel distance. In order to improve the ion-collecting efficiency for a given current density and to reduce the thermal load density at the collector 32, it is necessary to arrange the collector 32 as far as possible from the neutral beam so that the ion beam may be sufficiently deflected. By the way, the ion beam current depends upon the space charge limited current. The space charge limited current, the location of the collector 32, and the collector potential Vcol have a predetermined relationship. Current density j of the deuterium ions $D^+$ collected at the collector 32 may be expressed by the relation:

$$j \alpha (Va^{3/2} + \delta V^{3/2})^2 / d^2 \quad (1)$$

where d is the travel path of the ion beam between the suppressor 34*a* and the collector 32, and $\delta V$ is the difference between the initial potential Va of the high energy ions and the collector potential Vcol. From this relation, it is seen that the current density j is inversely proportional to the square of the distance d and is decreased with a decrease in potential difference $\delta V$. In other words, the closer the collector 32 to the neutralizing cell 14 and the lower the collector potential Vcol, the larger the current density j. By the way, when the current density of the ion beam is set at a predetermined value so as to obtain a proper beam of neutral particles D° and the collector potential Vcol is set at a predetermined value so as to obtain a predetermined ion-collecting efficiency, the location of the electrode is determined. Due to this limitation, the collector 32 is conventionally located at a position at which the ion beam is not sufficiently deflected. Then, the considerable ions are not collected by the collector 32 but leak through an opening which is formed at the center of each electrode and which is designed to permit passage of the neutral particles. Since the collector 32 is close to the neutralizing cell 14, the ion current density at the collector 32 is high. For this reason, the thermal load density of the collector cannot be decreased to a desirable value. This has degraded the ion-collecting efficiency of the neutral beam injector 18 and has made the design of the direct converter difficult.

SUMMARY OF THE INVENTION

It is an object of the present invention to provide a neutral beam injector which reduces the thermal load density of the collector and which improves the efficiency of energy recovery.

In order to achieve the above object, a deflector is provided for a direct converter constituting a neutral beam injector. The deflector is interposed between a neutralizing cell for neutralizing the charged particles and a collector in order to make the beams of the charged particles cross each other and diverge. Better effects are obtained when the deflector comprises a first deflecting electrode to which is applied a potential higher than the potential of the collector, and a second deflecting electrode to which is applied a potential lower than the collector and which is interposed between the first deflecting electrode and the collector.

With the neutral beam injector of the configuration described above, since the efficiency of energy recovery may be improved, a power source of smaller capacity may be used for the neutral beam injector.

BRIEF DESCRIPTION OF THE DRAWINGS

Other objects and advantages of the invention will become apparent from the following detailed description when taken in conjunction with the accompanying drawings.

DETAILED DESCRIPTION OF THE PREFERRED EMBODIMENTS

Figure 1:
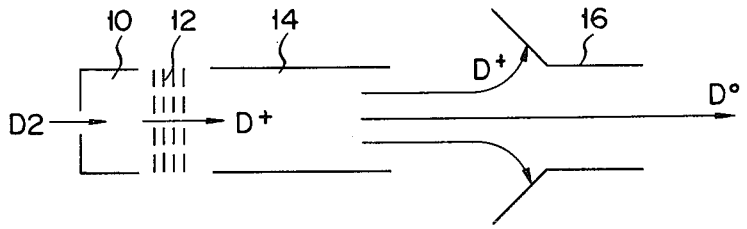
FIG. 1 is a schematic view of a conventional neutral beam injector.
Figure 2:
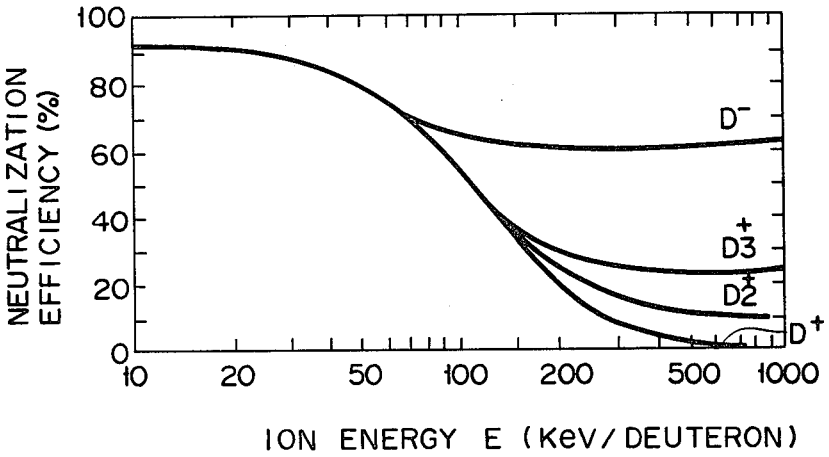
FIG. 2 is a graph showing the relationship between the ion energy and the neutralization efficiency.
Figure 3:
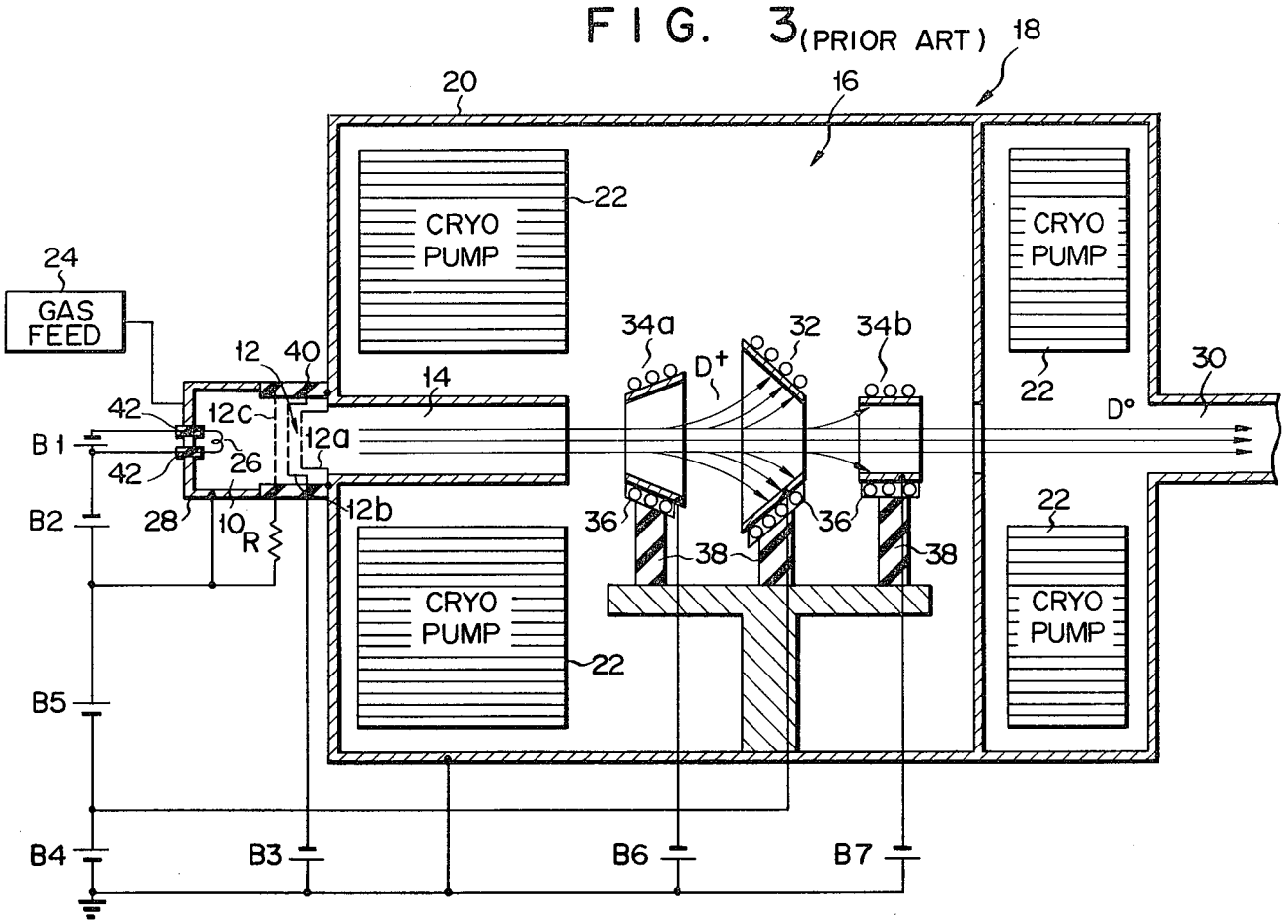
FIG. 3 (PRIOR ART)
FIG. 3 is a sectional view of a neutral beam injector having a conventional direct converter, and a circuit diagram of the direct converter.
Figure 4:
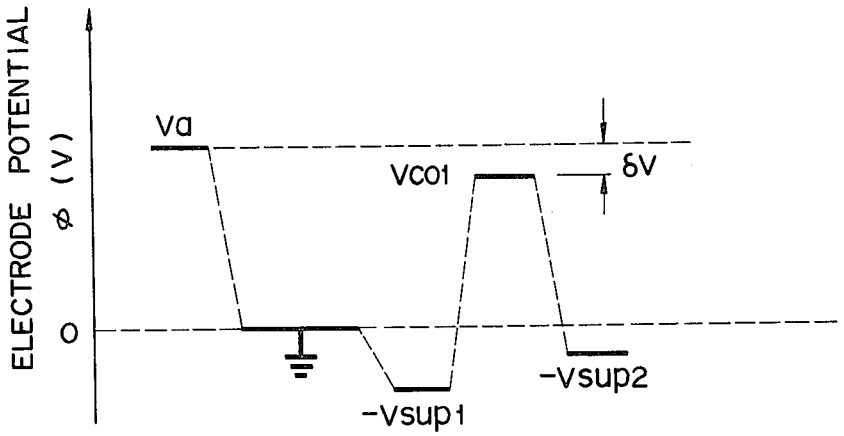
FIG. 4 is a graph showing the potential distribution at each part of the neutral beam injector shown in FIG. 3.
Figure 6:
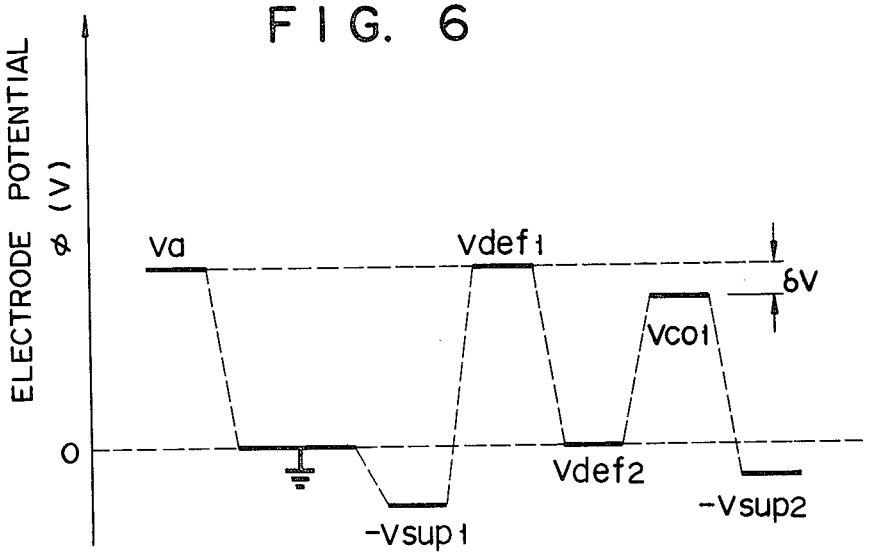
FIG. 6 is a graph showing the potential distribution at each part of the neutral beam injector shown in FIG. 5.
Figure 5:
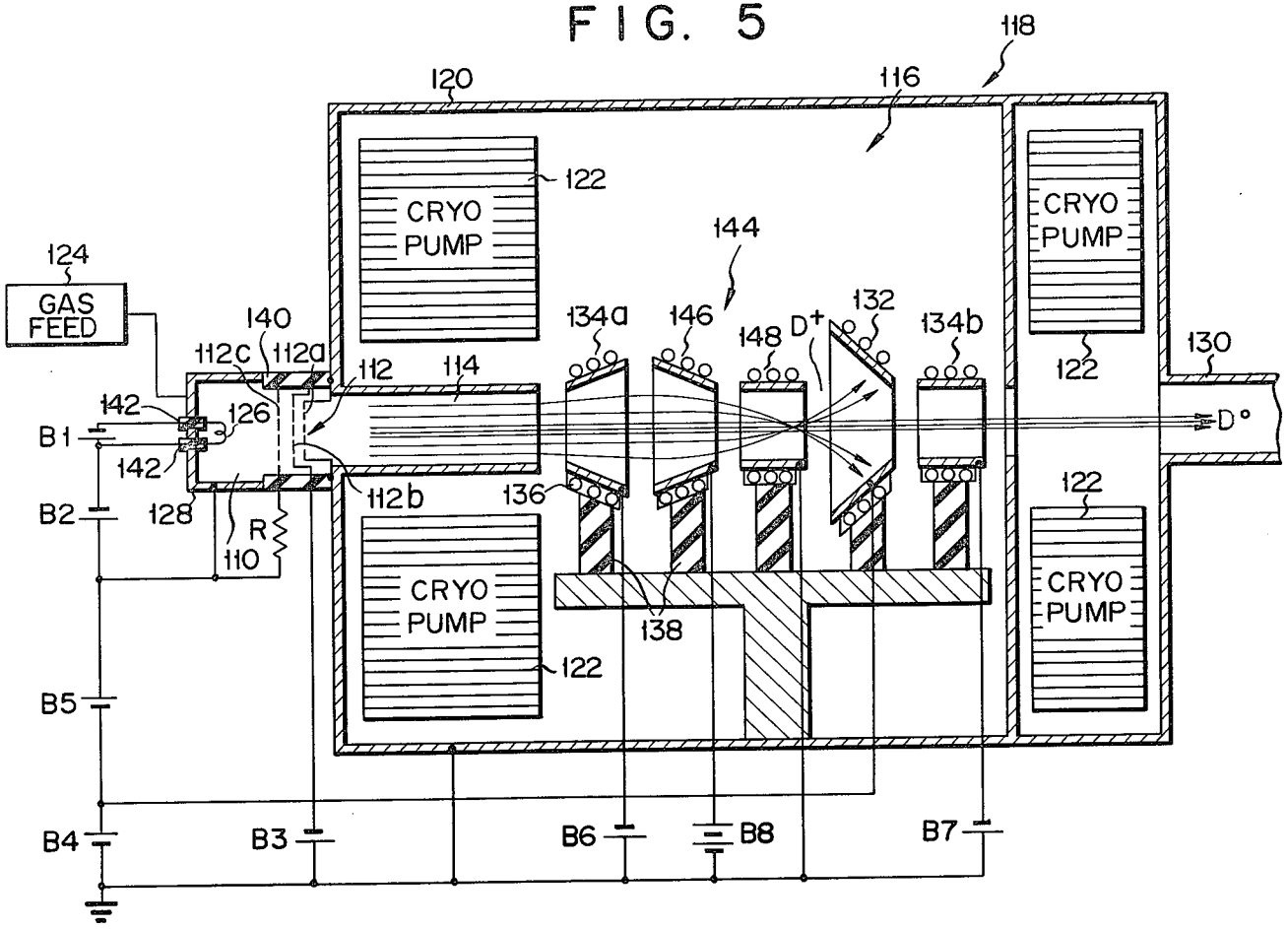
FIG. 5 is a sectional view of a neutral beam injector according to a first embodiment of the present invention, and a circuit diagram thereof.

The neutral beam injector according to the first embodiment of the present invention will now be described with reference to FIGS. 5 and 6. FIG. 5 is a schematic sectional view of a neutral beam injector 118, and a circuit diagram thereof. FIG. 6 shows the potential distribution at each part of the neutral beam injector 118. Neutral molecules of deuterium are introduced from a gas feed 124 into a discharge chamber 110 of the neutral beam injector 118. A discharge electrode 128 and an electron-emissive filament 126 are arranged inside the discharge chamber 110. The electrons emitted from the filament 126 are accelerated by the discharge electrode 128 and generate D+ ions from the neutral molecules. The D+ ions are accelerated by an accel-decel grid 112 and guided to a neutralizing cell 114. The D+ ions are subjected to a charge-exchange reaction at the neutralizing cell 114 to produce neutral high-energy deuterium particles D°. The high-energy deuterium particles D° are guided to a plasma through a direct converter 116 and a drift tube 130. The neutralizing cell 114 and the direct converter 116 are arranged inside a vacuum vessel 120. The vacuum vessel 120 is evacuated by cryo pumps 122.

The direct converter 116 comprises a collector 132, a pair of electron suppressors **134*a* and 134*b* which are arranged in front of and behind the collector 132, respectively, and a deflector 144 interposed between the electron suppressors 134*a* and the collector 132. The electron suppressor 134*a* prevents the electrons generated in the neutralizing cell 114 from flowing to the direct converter 116, and the electron suppressor 134*b* prevents the electrons generated in the drift tube 130 from flowing to the direct converter 116. The deflector 144 comprises a first deflecting electrode 146 which is set at the same potential as that of the discharge electrode 128, and a second deflecting electrode 148 which is set substantially at the ground potential. The first deflecting electrode 146 serves as an electrostatic lens which guides parallel beams of deuterium ions D+ to the vicinity of the second deflecting electrode 148. The beams of deuterium ions D+ guided to the vicinity of the second deflecting electrode 148 cross each other and are diverged. In a conventional neutral beam injector, the deuterium ions D+ are deflected by the space charge of the ion beam itself. However, in the neutral beam injector 118 of the present invention, as shown in FIG. 5, the ions are positively deflected utilizing the repelling force between the ion beam and the first deflecting electrode 146 at high potential. The degree of deflection of the beam may be arbitrarily controlled by adjusting the potential and location of the first deflecting electrode. The second deflecting electrode 148 is provided to eliminate the effects of the space charge limited current described above. Cooling pipes 136 for preventing the temperature of the collector 132 and the electron suppressors 134*a* and 134*b* from rising are arranged around the collector 132 and the electron suppressors 134*a* and 134*b*. The collector 132, the electron suppressors 134*a* and 134*b*, and the first and second deflecting electrodes 146 and 148 are held in the vessel 120 by means of insulators 138. The vessel 120, the neutralizing cell 114, and a first grid 112*a* are electrically connected each other. The first grid 112*a*, a second grid 112*b*, a third grid 112*c* and the discharge electrode 128 are insulated by a insulator 140**, respectively.

The filament 126 and the discharge electrode 128 are insulated by insulators 142.

The electrical connections of the neutral beam injector 118 according to the present invention will now be described with reference to FIG. 5. The vacuum vessel 120, the neutralizing cell 114 connected to the vacuum vessel 120, and the first grid 112*a* of the accel-decel grid 112 are grounded. The filament 126 is connected to the filament heater power source B1, and the discharge electrode 128 is connected to the discharge power source B2. The third grid 112*c* is connected to the discharge power source B2 through the resistor R. The second grid 112*b* is set at a negative potential by the power source B3 in order to prevent the electrons in the discharge chamber 110 from flowing into the neutralizing cell 114.

The discharge electrode 128 is set at the positive high potential Va, for example, 200 kV, by the power sources B4 and B5. Therefore, the ions receive an energy corresponding to the potential Va. The electron suppressor 134*a* is set at the negative potential −Vsupl, for example, −60 kV, by the power source B6. The electron suppressor 134*b* is set at the negative potential −Vsup2, for example, −20 kV, by the power source B7.

The first deflecting electrode 146 is set at a positive potential Vdefl, for example, 200 kV, by a power source B8. The second deflecting electrode 148 is grounded at a potential Vdef2, that is, zero. The collector 132 is connected to a node of the power sources B4 and B5. Therefore, the potential of the collector 132 is set at the positive potential Vcol, for example, 190 kV, by the power source B4. The potential distribution at each part of the neutral beam injector 118 as described above becomes as shown in FIG. 6.

With the configuration as described above, the beams of deuterium ions $D^+$ cross each other near the second deflecting electrode 148, so that the deuterium ions $D^+$ have a velocity in the y-direction. Then, the deflection of the deuterium ions $D^+$ becomes greater than in the conventional case. Even when the collector 132 is brought closer to the second deflecting electrode 148, the efficiency of collection of the deuterium ions $D^+$ may be made significantly high. Therefore, even when the collector 132 is located so that a predetermined deterium ion current density j and a predetermined potential difference $\delta V$ is maintained, the deuterium ions $D^+$ may be collected with satisfactory efficiency. As a consequence, since the leakage of the ions through the central opening of the direct converter 116 may be reduced to the minimum, the conversion efficiency of the direct converter 116 may be improved.

Since the ion beam may be deflected more than in the conventional case, the current density j near the collector 132 is reduced as compared with that obtainable with the conventional direct converter even if the current densities of the ion beams before being deflected are equal in both cases. It is seen from relation (1) that a smaller potential difference $\delta V$ is obtainable with the direct converter of the present invention than with the conventional one if the collector is located at the same distance d. As a result, the potential Vcol may be increased.

Since the efficiency of energy conversion by the direct converter is high, the power source for the ion source may be of smaller capacity.

The location of the collector 132 is not limited as much as in the conventional case. The collector 132 may, therefore, be located at a considerable distance from the second deflecting electrode 148, and the dielectric breakdown strength between the electrodes may be improved. In a conventional direct converter, the electron suppressor 34*a* and the collector 32 must be located close to each other due to limits imposed by the space charge limited current.

Figure 7:
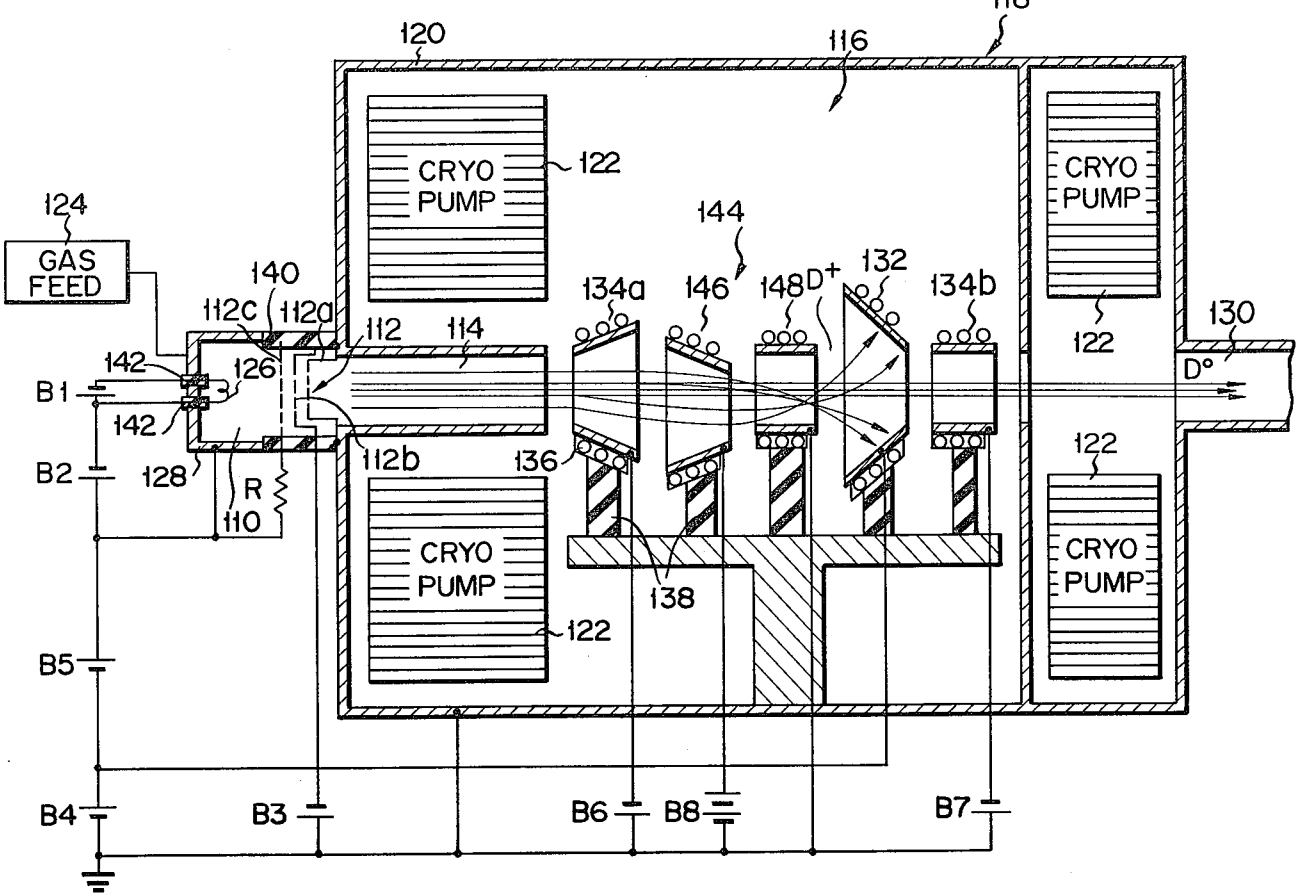
FIG. 7 is a sectional view of a neutral beam injector according to a second embodiment of the present invention, and a circuit diagram thereof.

A neutral beam injector according to the second embodiment of the present invention will now be described with reference to FIG. 7. The same reference numerals in FIG. 7 denote the same parts as in FIG. 5, and the detailed description thereof will be omitted. In the neutral beam injector shown in FIG. 5, the central axes of all the electrodes are aligned with the central axis of the neutral beam. On the other hand, in the neutral beam injector of this embodiment, the central axis of the first deflecting electrode 146 is shifted from the central axis of the beam. In the first embodiment, regardless of the potential applied to the electrode or the location of the electrode in the x-direction, the ions which pass near the central axis of the electrode are only slightly deflected. Therefore, these ions are not collected by the collector 132 and pass away. However, in the second embodiment, since the first deflecting electrode 146 is shifted from the central axis of the ion beam, the ratio of the ions which travel straight may be reduced.

In the embodiment described above, the second deflecting electrode 148 is grounded. However, it is only necessary to set the second deflecting electrode 148 at a potential lower than that of the collector 132. The neutralizing cell 114 need not always be grounded. The electrode need not be columnar, but may be flat. The electron suppressor 134*a* is not limited to an electric field supplying means, but may be a magnetic field supplying means.

What is claimed is:

1. A neutral beam injector comprising:

means for generating charged particles;

a neutralizing cell for neutralizing charged particles; and a direct converter for recovering the energy of unneutralized charged particles passed through said neutralizing cell, said direct converter having means for collecting charged particles, deflecting means, interposed between said neutralizing cell and said means for collecting charged particles, for crossing and diverging beams of the charged particles, first electron suppressing means interposed between said neutralizing cell and said deflecting means, and second electron suppressing means arranged behind said collecting means.

2. A neutral beam injector according to claim 1, wherein said deflecting means comprises a first deflecting electrode which is set at a potential higher than a potential at said means for collecting charged particles.

3. A neutral beam injector according to claim 2, wherein said deflecting means further comprises a second deflecting electrode which is interposed between said means for collecting charged particles and said first deflecting electrode and which is set at a potential lower than the potential of said means for collecting charged particles.

4. A neutral beam injector according to claim 2 or 3, wherein a central axis of said first deflecting electrode is shifted from a central axis of a neutral beam.

* * * * *